US011602652B2

(12) United States Patent
Azuma et al.

(10) Patent No.: US 11,602,652 B2
(45) Date of Patent: Mar. 14, 2023

(54) WATER-DISCHARGING MACHINE

(71) Applicant: ASHIMORI INDUSTRY CO., LTD., Settsu (JP)

(72) Inventors: Katsuhiko Azuma, Settsu (JP); Izumi Taniguchi, Settsu (JP)

(73) Assignee: ASHIMORI INDUSTRY CO., LTD., Settsu (JP)

( * ) Notice: Subject to any disclaimer, the term of this patent is extended or adjusted under 35 U.S.C. 154(b) by 324 days.

(21) Appl. No.: 17/058,218

(22) PCT Filed: May 25, 2018

(86) PCT No.: PCT/JP2018/020201
§ 371 (c)(1),
(2) Date: Nov. 24, 2020

(87) PCT Pub. No.: WO2019/225015
PCT Pub. Date: Nov. 28, 2019

(65) Prior Publication Data

US 2021/0187336 A1 Jun. 24, 2021

(51) Int. Cl.
*A62C 27/00* (2006.01)
*A62C 99/00* (2010.01)

(52) U.S. Cl.
CPC ..... *A62C 27/00* (2013.01); *A62C 99/0072* (2013.01)

(58) Field of Classification Search
CPC ..... A62C 27/00; A62C 99/0072
(Continued)

(56) References Cited

U.S. PATENT DOCUMENTS 1,064,883 A * 6/1913 Bergland ..... B65H 75/403 239/745
1,683,911 A * 9/1928 Morris ..... F01P 11/02 239/196

(Continued)

FOREIGN PATENT DOCUMENTS

CN 201969228 U 9/2011
CN 202355752 U 8/2012

(Continued)

OTHER PUBLICATIONS

Communication dated Aug. 24, 2022 by the State Intellectual Property Office of P R. China in counterpart Chinese Application No. 201880093682.1.

(Continued)

*Primary Examiner* — Steven J Ganey
(74) *Attorney, Agent, or Firm* — Sughrue Mion, PLLC

(57) ABSTRACT

Provided is a fire-fighting system that has a very simple structure with only a hose and a water discharge nozzle mounted on a vehicle, can bring the vehicle close to the fire site by automatic operation or remote control, and minimizes the occurrence of a water hammer when water is supplied. A hose reel is installed on a base which is installed on a vehicle, so as to be rotatable around a rotary shaft extending vertically, a hose having shape retaining property is spirally wound around the hose reel and around the rotary shaft, the lower end of the hose is connectable to a water discharge pump installed behind the vehicle, and the upper end of the hose passes through the rotary shaft of the hose reel and is connected to a water discharge nozzle installed at the upper position of the vehicle.

13 Claims, 8 Drawing Sheets

(58) Field of Classification Search
USPC ..... 169/64, 70; 239/195–197, 745
See application file for complete search history.

(56) References Cited

U.S. PATENT DOCUMENTS

| | | | | |
|---|---|---|---|---|
| 2,694,455 | A * | 11/1954 | Eickmeyer | A62C 25/005 169/24 |
| 4,103,841 | A | 8/1978 | Flynn et al. | |
| 4,254,912 | A * | 3/1981 | Lebrun | A01G 25/095 239/745 |
| 5,236,131 | A | 8/1993 | Hayward | |
| 2008/0099212 | A1* | 5/2008 | Do | A62C 27/00 169/24 |

FOREIGN PATENT DOCUMENTS

| | | | |
|---|---|---|---|
| CN | 103241601 | A | 8/2013 |
| GB | 577487 | A | 5/1946 |
| JP | 49-27399 | A | 3/1974 |
| JP | 7-155395 | A | 6/1995 |
| JP | 8-66490 | A | 3/1996 |
| JP | 11-42292 | A | 2/1999 |
| JP | 2001-87408 | A | 4/2001 |
| JP | 2003-320052 | A | 11/2003 |
| JP | 2004-202095 | A | 7/2004 |
| JP | 2009-286619 | A | 12/2009 |
| KR | 10-0429106 | B1 | 5/2004 |
| PL | 68693 | Y1 | 11/2016 |
| TW | M512420 | U | 11/2015 |

OTHER PUBLICATIONS

International Search Report dated Aug. 21, 2018 issued by the International Searching Authority in counterpart International Application No. PCT/JP2018/020201 (PCT/ISA/210).

International Written Opinion dated Aug. 21, 2018 issued by the International Searching Authority in counterpart International Application No. PCT/JP2018/020201 (PCT/ISA/237).

Xiaoqing, Xie, "Operation, Maintenance and Management of Drainage Pipeline", p. 28, Xiamen University Press, Aug. 2017. (4 pages total).

Office Action dated Sep. 22, 2021 by the State Intellectual Property Office of P.R. China in counterpart Chinese Patent Application No. 201880093682.1.

* cited by examiner

1 WATER-DISCHARGING MACHINE

WATER-DISCHARGING MACHINE

CROSS-REFERENCE TO RELATED APPLICATIONS

This application is a National Stage of International Application No. PCT/JP2018/020201, filed May 25, 2018, the content of all of which is incorporated herein by reference in its entirety.

TECHNICAL FIELD

The present invention relates to a water-discharging machine capable of being quickly dispatched to a fire site and strongly discharging a large amount of water when a fire occurs in a region and a facility, such as a nuclear reactor, where it is generally difficult to perform a fire extinguishing activity.

In particular, the present invention relates to a water-discharging machine including a large-diameter hose and a water discharge nozzle that are mounted on a vehicle such as a truck, drawing the hose out from the vehicle while the vehicle rushes into a fire site, and supplying water into the hose from behind the vehicle so as to be capable of discharging a large amount of water.

BACKGROUND ART

In a fire of a nuclear reactor and the like, it is necessary to quickly dispatch a water-discharging machine and discharge a large amount of water as in a normal fire, but more water is required in fire extinguishing compared with the normal fire, and accordingly, it is necessary to supply water with a thick hose.

In the normal fire, the hose has a thickness of about 65 mm at most, and a water discharge pressure is about 0.3 MPa, but it is necessary to supply high-pressure water of 1.2 MPa or higher with a particularly thick hose of about 150 mm in the nuclear reactor fire.

It is impossible for a firefighter to grasp such a thick hose and to discharge water, and it is necessary to mount a wound hose and a water discharge nozzle on the vehicle, to deliver the hose from a rear of the vehicle to make the vehicle rush into a fire site, and to feed water into the hose from behind the vehicle to discharge water from the water discharge nozzle.

As shown in JP-A-2001-87408, in a related-art fire engine, there is provided a basic water discharge system in which a water suction hose, a water discharge hose, and a pump are mounted on the fire engine, water is suctioned from the water suction hose and stored in a water tank provided in the fire engine, and the water in the water tank is discharged with the pump using a water discharge hose.

In this case, the water discharge hose is delivered, the firefighter grasps the water discharge nozzle which is at a tip end of the water discharge hose, and the pump mounted on the fire engine pressurizes water to discharge the water. However, in order to supply high-pressure water to a large-diameter hose as described above, the pump mounted on the fire engine cannot catch up with it, and the water tank mounted on the fire engine quickly becomes empty due to water discharge. Therefore, it is necessary that a large pump installed behind the vehicle feeds water, and that the vehicle mounts a nozzle and is dedicated to discharging water.

In a related-art fire-fighting system, such a system, in which the vehicle is equipped with only the hose and the nozzle, moves forward while delivering the hose backward, and supplies water to the hose by the large pump installed behind the vehicle described above and discharges the water from the water discharge nozzle mounted on the vehicle, is not present.

Further, in a nuclear reactor fire, a person often cannot enter the fire site, and it is necessary to bring the vehicle closer to the fire site by automatic operation or remote control and remotely control the water discharge nozzle to discharge water. Further, even if a problem occurs in the water-discharging machine, a person cannot enter and the problem cannot be solved.

Therefore, the water-discharging machine must be as simple in structure as possible and not cause a water hammer and the like when supplying water. If the water hammer is generated in the large-diameter hose as described above, the vehicle equipped with the hose may be turned over.

CITATION LIST

Patent Literature

Patent Literature 1: JP-A-2001-87408

SUMMARY OF INVENTION

Technical Problem

The present invention has been made in view of the above circumstances, and provides a fire-fighting system having a very simple structure with only a hose and a water discharge nozzle that are mounted on a vehicle, which is capable of bringing the vehicle close to a fire site by automatic operation or remote control, minimizing the occurrence of a water hammer during water supply, and strongly discharging a large amount of water.

Solution to Problem

In the present invention, a hose reel is mounted on a base that is mounted on a vehicle so as to be rotatable around a rotary shaft that extends vertically, a hose having a shape retaining property is spirally wound around the rotary shaft on the hose reel, a lower end of the hose is connectable to a water discharge pump installed behind the vehicle, and an upper end of the hose passes through the rotary shaft of the hose reel and is connected to a water discharge nozzle mounted at an upper position of the vehicle.

It is preferable to use the hose configured such that a lining made of rubber or soft synthetic resin is applied to an inner surface of a jacket including a plurality of warp yarns and rigid weft yarns spirally woven with respect to the warp yarns.

In the present invention, it is preferable that a spiral rib is protruded from an outer periphery of the hose reel, and the hose is wound between the rib.

Further, in the present invention, it is preferable that the hose reel is rotationally driven by rotary driving means mounted on the vehicle to deliver the hose backward from the hose reel when the vehicle moves forward.

Further, in this case, it is preferable that a hose delivery member configured to move up and down in conjunction with the rotation of the hose reel so as to correspond to a position of the hose delivered from the hose reel is provided on the base.

Further, in this case, it is preferable that a screw rod stands upright from the base and is caused to rotate in conjunction with the hose reel, and the hose delivery member is screwed to the screw rod and is configured to correspond to the position of the hose delivered from the hose reel by the rotation of the screw rod.

Further, in the present invention, it is preferable that a hose receiving member that draws a substantially cylindrical shape is provided around the hose reel around which the hose is wound, and the substantially cylindrical shape has an inner periphery slightly larger than an outer periphery of the hose wound around the hose reel.

It is preferable that the hose receiving member is configured such that a plurality of rotary rods stand upright from the base so as to draw the substantially cylindrical shape having the inner periphery slightly larger than the outer periphery of the hose wound around the hose reel.

Further, in the present invention, it is preferable that the water discharge nozzle is mounted on an upper base positioned above the hose reel, and an upper end of the rotary shaft is rotatably coupled to the water discharge nozzle. Further, it is also preferable that the water discharge nozzle is installed at the uppermost part of the vehicle, and an upper portion of the rotary shaft is coupled to a connecting pipe connected to the water discharge nozzle via a rotary joint.

Further, as a connection structure of the water discharge nozzle, a lower end of the rotary shaft can be coupled to a connecting pipe via a rotary joint, the connecting pipe can be connected to the discharge nozzle mounted in the vehicle, and an air vent valve can be provided on an upper end of the rotary shaft.

Further, in the present invention, it is preferable that the vehicle is caused to travel by automatic driving or remote control. In this case, it is preferable that the water discharge nozzle is rotatable vertically and horizontally by the remote control.

DESCRIPTION OF EMBODIMENTS

Figure 1:
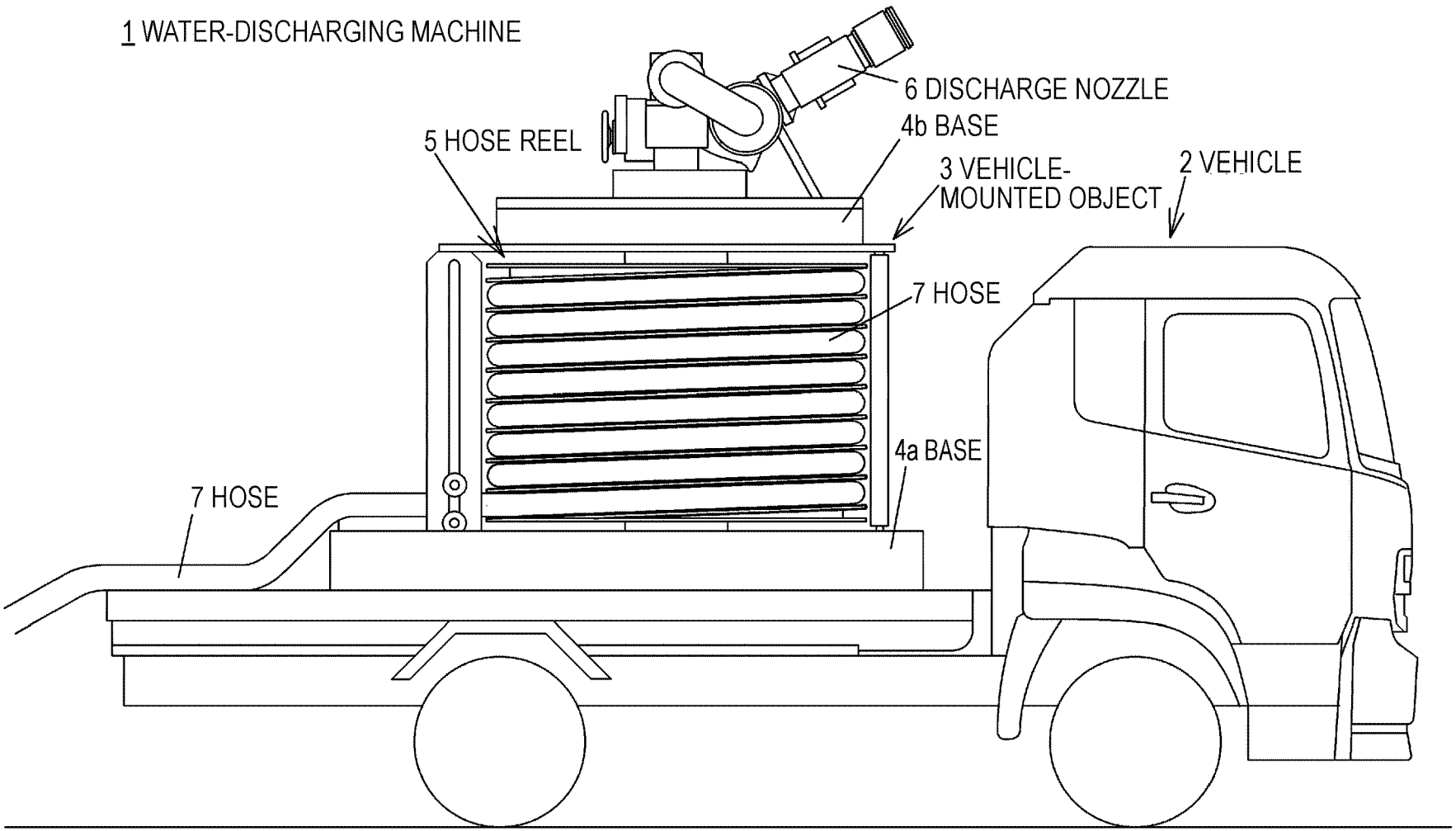
FIG. 1 is a side view showing an example of a water-discharging machine according to the present invention.

Hereinafter, the present invention will be described with reference to the drawings. FIG. 1 shows an example of a water-discharging machine 1 of the present invention. A vehicle-mounted object 3 is mounted on a cargo bed of a vehicle 2 such as a truck. In the vehicle-mounted object 3, a hose reel 5 is rotatably mounted on a base (lower base) 4*a*, and a hose 7 is spirally wound around the hose reel 5.

A water discharge nozzle 6 is mounted on a base (upper base) 4*b* positioned above the hose reel 5. An upper end of the hose 7 is connected to the water discharge nozzle 6. Further, a lower end of the hose 7 is drawn out backward of the vehicle 2.

Figure 2:
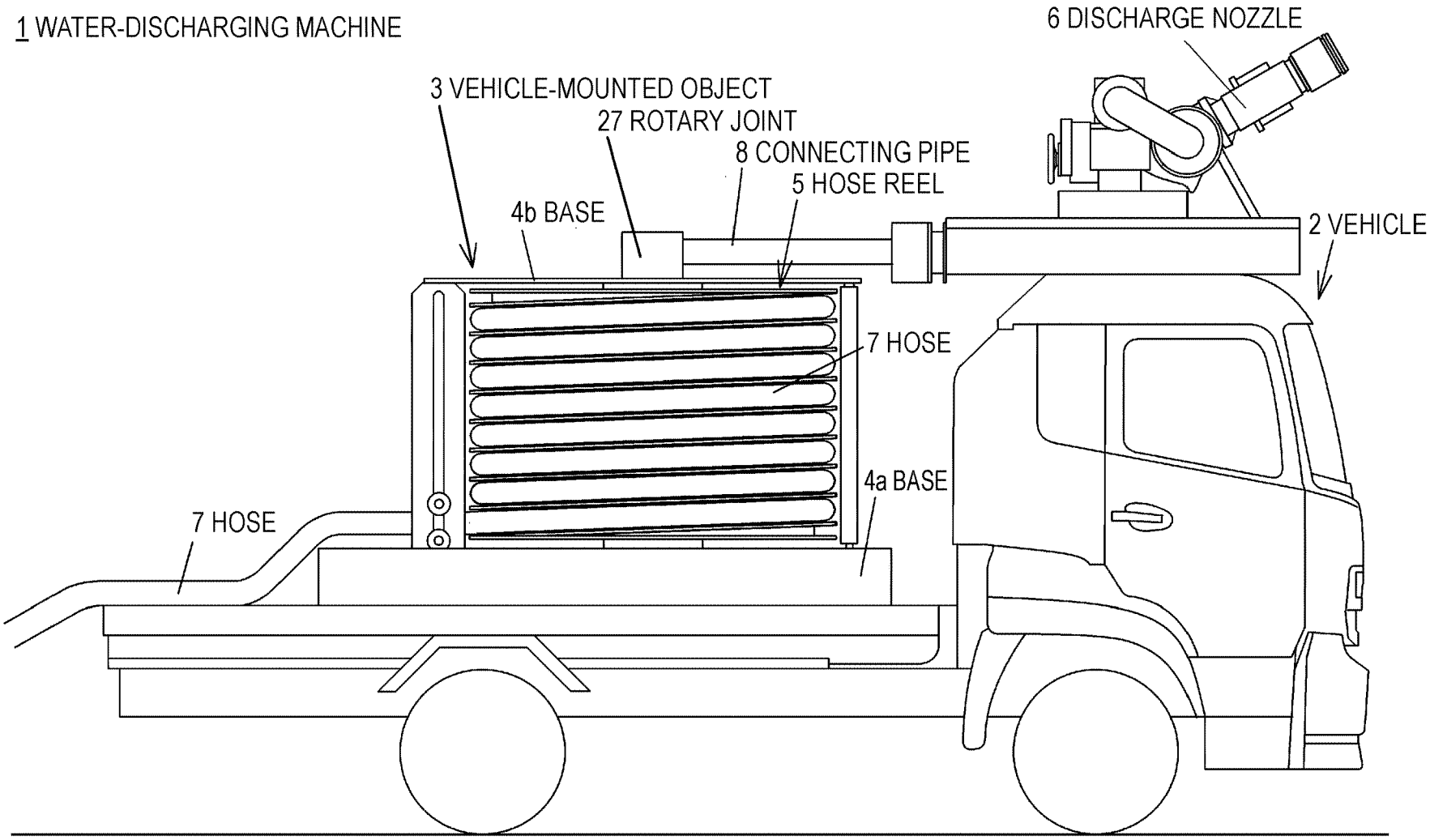
FIG. 2 is a side view showing another example of the water-discharging machine according to the present invention.

FIG. 2 shows another example of the water-discharging machine 1 of the present invention. The vehicle-mounted object 3 is mounted on the cargo bed of the vehicle 2. The water discharge nozzle 6 is placed on a ceiling of a driver seat which is the uppermost portion of the vehicle 2. The hose reel 5 and the water discharge nozzle 6 are connected by a connecting pipe 8 via a rotary joint 27.

Although the water-discharging machine 1 may be either the example shown in FIG. 1 or FIG. 2, it is preferable that, in any case, the water discharge nozzle 6 is mounted at a position as high as possible and at least at a position higher than an upper end of the hose reel 5.

Accordingly, when water is supplied to the hose 7 from behind, the water is sequentially filled from a lower side to an upper side of the hose 7, and finally discharged from the water discharge nozzle 6. Therefore, during this time, no air is present in the hose 7 and an effective cross-sectional area of the hose is not reduced, and the water hammer is less likely to occur, so that water can be safely discharged.

Figure 7A:
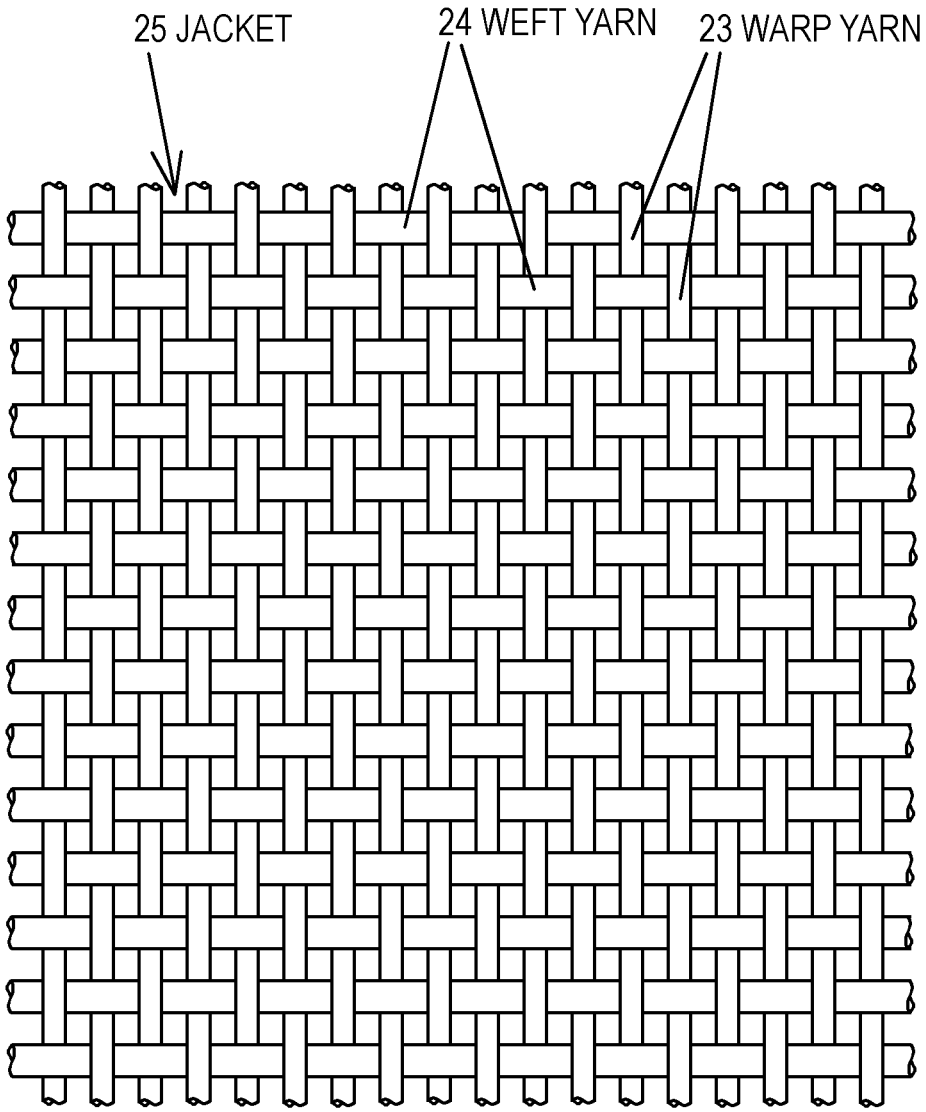
FIG. 7A is a surface view showing a hose in the present invention.
Figure 7B:
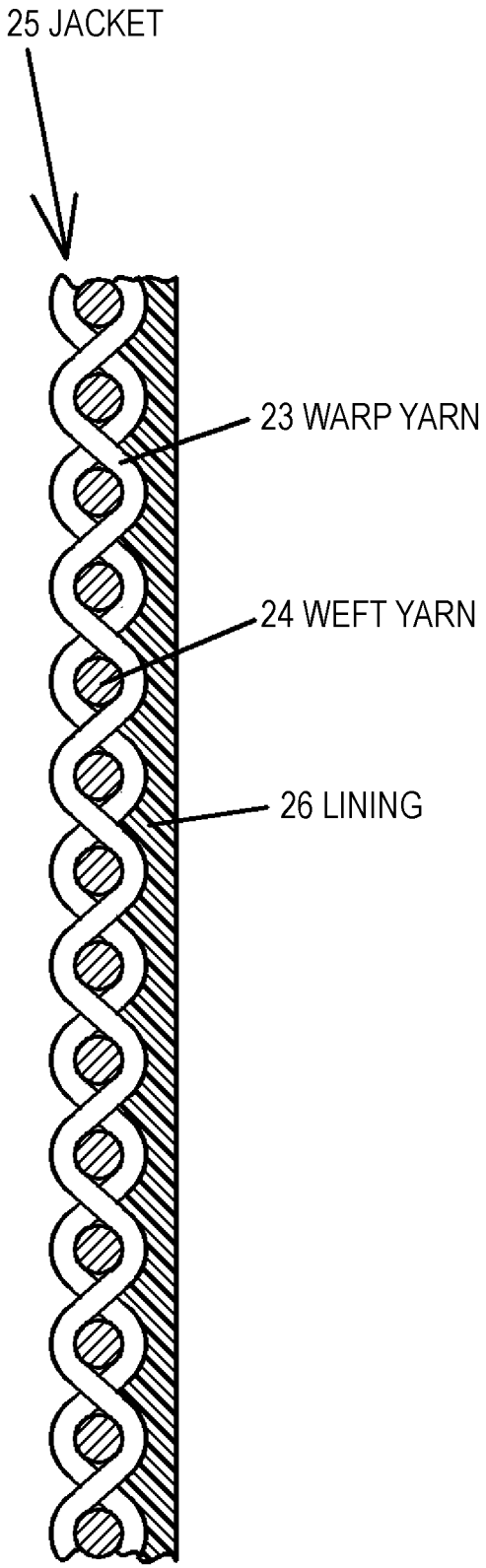
FIG. 7B is a longitudinal sectional view showing the hose in the present invention.

The hose 7 according to the present invention has a shape retaining property. For example, as shown in FIGS. 7A and 7B, a lining 26 made of rubber or soft synthetic resin is formed on an inner surface of a jacket 25 comprising a plurality of warp yarns 23 and rigid weft yarns 24 spirally woven with respect to the warp yarns 23. A metal wire, a bristle made of a hard plastic, and the like are suitable for the weft yarn 24.

The jacket 25 has a woven structure, and the warp yarn 23 is flexible but cannot be folded flat because the weft yarn 24 is rigid. Accordingly, the hose 7 is flexible enough to be wound around a cylindrical body 12 with a large diameter while the hose 7 itself maintains a cylindrical shape.

In the examples of FIGS. 7A and 7B, the weft yarns 24 are all rigid yarns, but when the rigidity of the jacket 25 is too high, it is also possible to use the rigid weft yarns 24 and normal thread yarns alternately as the weft yarns.

Figure 3:
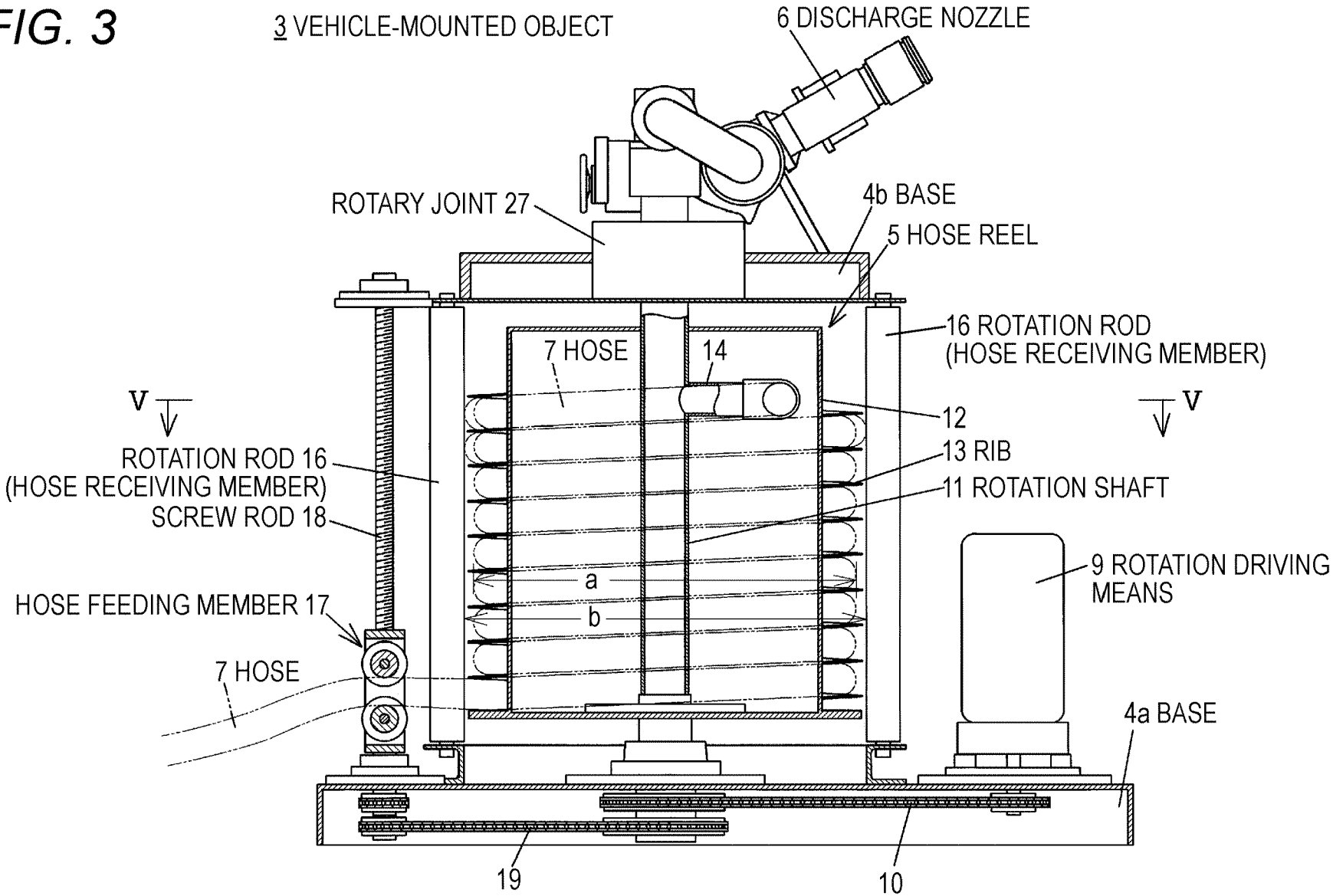
FIG. 3 is a central longitudinal sectional view of a vehicle-mounted object in the present invention.
Figure 4:
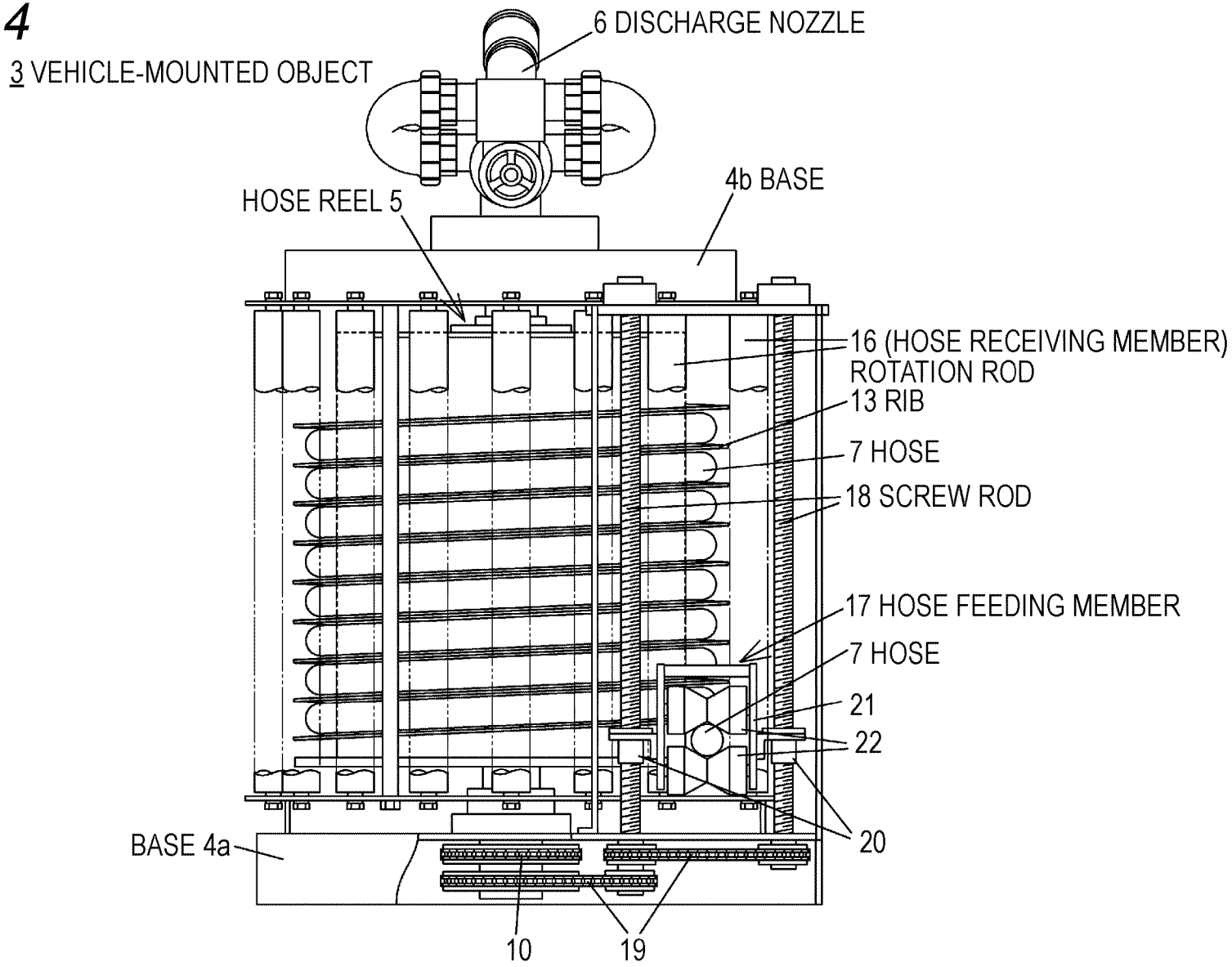
FIG. 4 is a back view in which a part of the vehicle-mounted object in the present invention is cut out.
Figure 5:
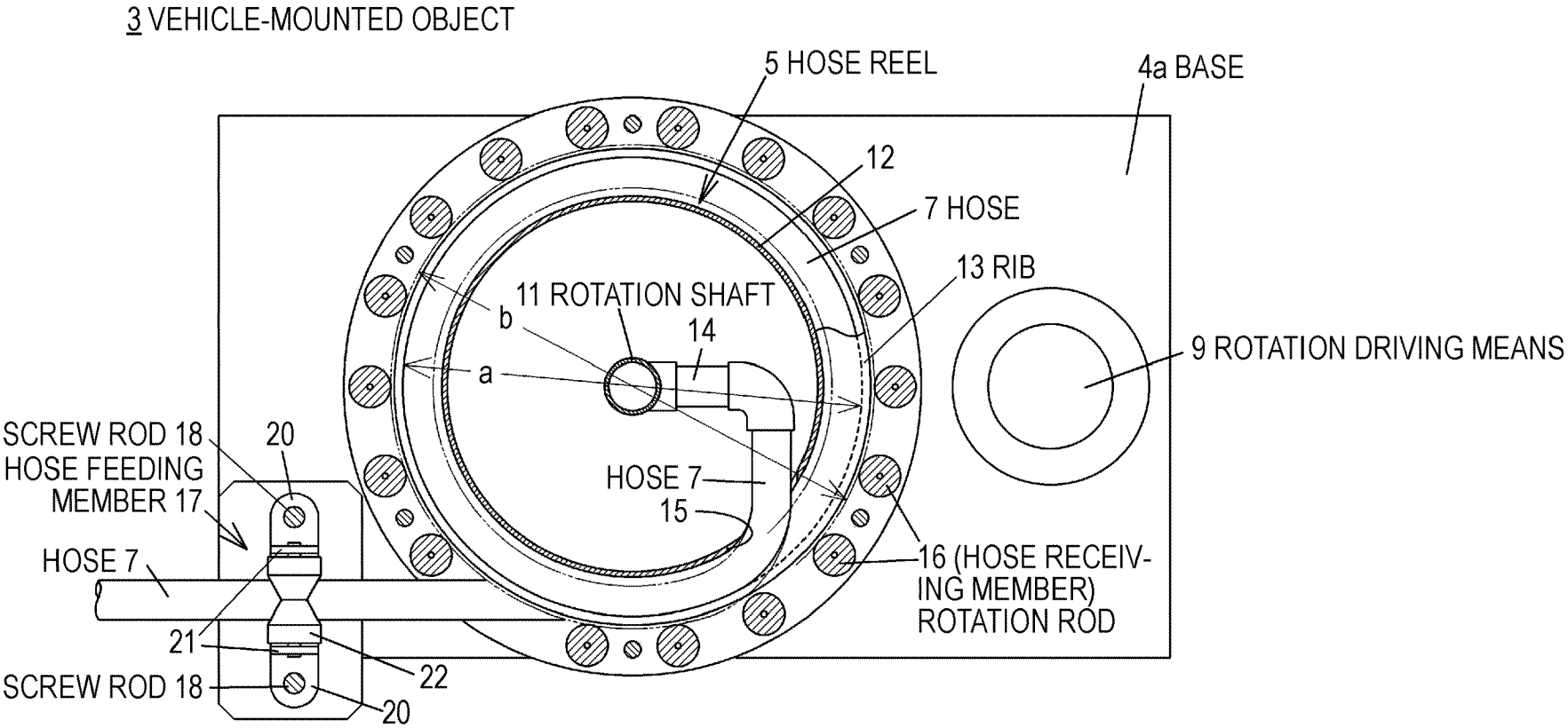
FIG. 5 is a cross-sectional view taken along a line V-V in FIG. 3 of the vehicle-mounted object in the present invention.

Next, FIG. 3 is a central longitudinal sectional view of the vehicle-mounted object 3 in the present invention, FIG. 4 is a back view of the vehicle-mounted object 3, and FIG. 5 is a cross-sectional view taken along a line V-V in FIG. 3. The hose reel 5 is rotatably attached to an upper portion of the lower base 4*a*, and the hose reel 5 is rotated via a chain 10 provided in the lower base 4*a* by a motor 9 serving as rotary driving means mounted on a side portion of the lower base 4*a*.

A hollow rotary shaft 11 stands upright at a center of the hose reel 5. The cylindrical body 12 is formed by surrounding the rotary shaft 11, and a spiral rib 13 protrudes from an outer periphery of the cylindrical body 12.

A branch pipe 14 is attached to an upper side portion of the rotary shaft 11, and the upper end of the hose 7 is connected to the branch pipe 14. The hose 7 extends out of the cylindrical body 12 from a through hole 15 formed in the cylindrical body 12, and is spirally wound between the rib 13.

Further, as shown in FIG. 5, a plurality of rotary rods 16 rotatably stand upright from the lower base 4*a* such that the plurality of rotary rods 16 surround the periphery of the hose reel 5. An inner periphery "b" at the positions where the plurality of rotary rods 16 standing upright is slightly larger than an outer periphery "a" of the hose 7 wound around the hose reel 5. An upper end of the rotary rod 16 is rotatably attached to the upper base 4*b*. The inner periphery of the rotary rod 16 forms a substantially cylindrical hose receiving member.

In this way, as shown in FIGS. 3 and 5, when water pressure is applied to the hose 7 from behind, the hose 7 wound around the cylindrical body 12 stretches longitudinally to increase a winding diameter thereof, abuts against and is supported by the rotary rod 16, and the hose 7 is always located between the rib 13.

If there is not the hose receiving member, the hose 7 may stretch and loosen in a state of being wound around the hose reel 5, it would not be known in which direction the hose will loosen, and there is a possibility that the winding diameter of the hose 7 will become larger and the hose 7 will get over the rib 13 to collapse the winding, making it impossible to deliver the hose 7.

The water discharge nozzle 6 is mounted on the upper base 4*b*. The rotary shaft 11 is connected to the water discharge nozzle 6 via the rotary joint 27. Accordingly, the vehicle-mounted object 3 supplies water from the hose 7 to the water discharge nozzle 6 via the rotary shaft 11.

A hose delivery member 17 is provided at a rear portion of the vehicle-mounted object 3. A pair of screw rods 18 stand upright from the lower base 4*a*. The hose delivery member 17 is screwed to the screw rods 18. By rotating the screw rods 18 in conjunction with the hose reel 5 by the chain 19, the hose delivery member 17 corresponds to a position of the hose 7 delivered from the hose reel 5.

In the hose delivery member 17, frames 21 are fixed to a nut 20 screwed to the screw rod 18. A pair of rotation rollers 22 each having a narrowed central part are rotatably supported between the frames 21. A lower end portion of the hose 7 wound around the hose reel 5 is interposed between the rotation rollers 22. When the hose reel 5 is rotated, the hose 7 is delivered from the hose reel 5, and the delivery position is held by the hose delivery member 17.

The lower end of the hose 7 is delivered backward from the cylindrical body 12 of the hose reel 5. The lower end of the hose 7 extends backward through a space between the rotation rollers 22 in the hose delivery member 17, and is connected to a pump (not shown) provided behind the vehicle 2. Water is supplied from the pump into the hose 7 and discharged from the water discharge nozzle 6.

Then, the vehicle 2 moves forward in this state and the hose reel 5 is rotated by the motor 9, whereby the hose 7 is delivered as the vehicle 2 moves forward, and the delivery position is sequentially changed to a higher position.

Further, by transmitting the rotation of the hose reel 5 to the screw rod 18 by the chain 19, the screw rod 18 rotates, and the hose delivery member 17 rises accordingly. Accordingly, the delivery position of the hose 7 corresponds to the delivery position in the hose reel 5, and the hose 7 can be always delivered in a constant state.

Not limited to the means of the screw rods 18, the hose delivery member 17 can correspond to the delivery position of the hose 7 in conjunction with the rotation of the hose reel 5 by other means such as hydraulic pressure.

Although the vehicle 2 can move forward by operation of an operator, when the vehicle cannot move forward by the operation of the driver in the case of the nuclear reactor fire as described above, the vehicle 2 can move forward by automatic driving or remote control, and water can be discharged extremely safely. Further, in this case, it is preferable that the water discharge nozzle 6 is also rotatable vertically and horizontally by the remote control.

In the vehicle-mounted object 3 in the example of FIG. 1, the water discharge nozzle 6 is mounted on the upper portion of the hose reel 5, and water is directly supplied from the rotary shaft 11 of the hose reel 5 to the water discharge nozzle 6. However, as shown in the example of FIG. 2, in a case where the water discharge nozzle 6 is mounted at a place other than the upper portion of the hose reel 5, the rotary joint 27 may be provided on the upper portion of the hose reel 5, and the rotary joint 27 and the water discharge nozzle 6 may be connected by the connecting pipe 8.

Figure 6:
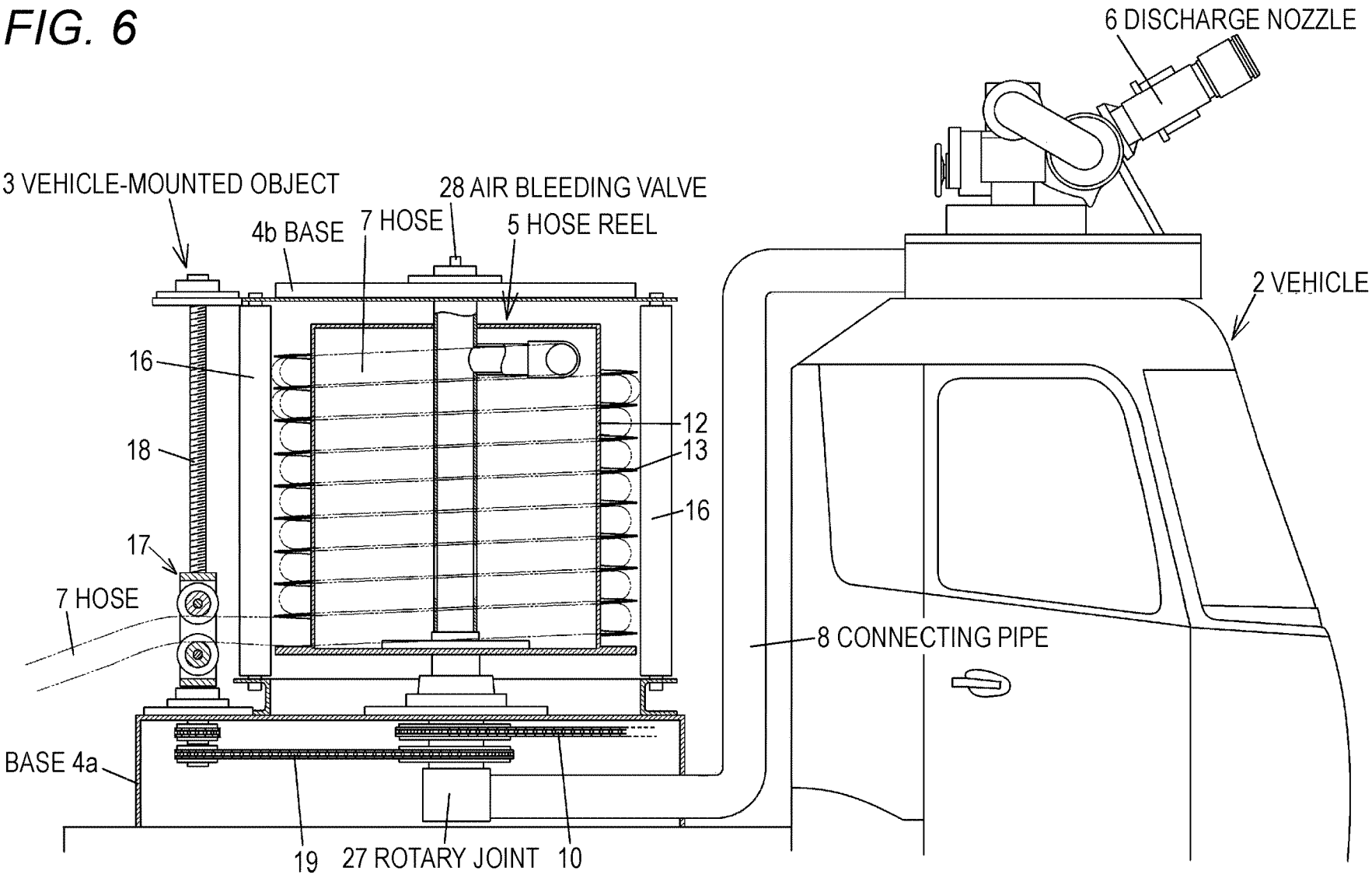
FIG. 6 is a central longitudinal sectional view showing another example of the vehicle-mounted object in the present invention.

Further, although in the above description, an upper end of the rotary shaft 11 is connected to the water discharge nozzle 6, the present invention is not limited to this structure. The connecting pipe 8 can be connected to a lower end of the rotary shaft 11 via the rotary joint 27 as shown in FIG. 6, and the connecting pipe 8 can be connected to the water discharge nozzle 6 mounted on the uppermost part of the vehicle 2.

In this case, once the water supplied from the hose 7 descends to the lower end of the rotary shaft 11, it is possible to prevent the occurrence of the water hammer due to air accumulation with a simple structure by providing an air vent valve 28 at the upper end of the rotary shaft 11.

The present invention is not limited to the above examples and is indicated by the scope of claims, and is intended to include meanings equivalent to the scope of claims and all modifications within the scope.

INDUSTRIAL APPLICABILITY

In the above description, the nuclear reactor fire is assumed, but the present invention can be widely used not only in a case of a fire such as the nuclear reactor where it is difficult to perform a fire extinguishing activity but also in a case where a large amount of water needs to be discharged at a high pressure.

The invention claimed is:

1. A water-discharging machine, comprising:

a base mounted on a vehicle;

a rotary shaft that extends vertically and upward from the base;

a hose reel mounted on the base so as to be rotatable around the rotary shaft;

a hose having a shape retaining property; and a water discharge nozzle mounted at an upper position of the vehicle, wherein the hose is spirally wound around the rotary shaft on an outer periphery of the hose reel, wherein a lower end of the hose is connectable to a water discharge pump installed behind the vehicle, and wherein an upper end of the hose passes through the rotary shaft of the hose reel and is connected to the water discharge nozzle.

2. The water-discharging machine according to claim 1, wherein the hose is configured such that a lining made of rubber or soft synthetic resin is applied to an inner surface of a jacket including a plurality of warp yarns and rigid weft yarns, the weft yarns being spirally woven with respect to the warp yarns.

3. The water-discharging machine according to claim 1, wherein a spiral rib is protruded from an outer periphery of the hose reel, and the hose is wound between the rib.

4. The water-discharging machine according to claim 1, further comprising:

a motor mounted on the vehicle, wherein the hose reel is rotationally driven by the motor to deliver the hose backward from the hose reel when the vehicle moves forward.

5. The water-discharging machine according to claim 4, further comprising:

a hose delivery member is provided on the base, the hose delivery member being configured to move up and down in conjunction with the rotation of the hose reel so as to correspond to a position of the hose delivered from the hose reel.

6. The water-discharging machine according to claim 5, further comprising:

a screw rod standing upright from the base, wherein the screw rod is caused to rotate in conjunction with the hose reel, and wherein the hose delivery member is screwed to the screw rod, and is configured to correspond to the position of the hose delivered from the hose reel by the rotation of the screw rod.

7. The water-discharging machine according to claim 1, further comprising:

a hose receiving member that draws a substantially cylindrical shape and that is provided around the hose reel around which the hose is wound, the substantially cylindrical shape having an inner periphery slightly larger than an outer periphery of the hose wound around the hose reel.

8. The water-discharging machine according to claim 7, wherein the hose receiving member is configured such that a plurality of rotary rods stand upright from the base so as to draw the substantially cylindrical shape having the inner periphery slightly larger than the outer periphery of the hose wound around the hose reel.

9. The water-discharging machine according to claim 1, further comprising:

an upper base positioned above the hose reel, wherein the water discharge nozzle is mounted on the upper base, and wherein an upper end of the rotary shaft is rotatably coupled to the water discharge nozzle.

10. The water-discharging machine according to claim 1, wherein the water discharge nozzle is installed at the uppermost part of the vehicle, and wherein an upper portion of the rotary shaft is coupled to a connecting pipe connected to the water discharge nozzle via a rotary joint.

11. The water-discharging machine according to claim 1, wherein a lower end of the rotary shaft is coupled to a connecting pipe via a rotary joint, and the connecting pipe is connected to the discharge nozzle mounted in the vehicle, and wherein an air vent valve is provided on an upper end of the rotary shaft.

12. The water-discharging machine according to claim 1, wherein the vehicle is caused to travel by automatic driving or remote control.

13. The water-discharging machine according to claim 12, wherein the water discharge nozzle is rotatable vertically and horizontally by the remote control.

* * * * *